United States Patent [19]

Rose

[11] 4,190,921

[45] Mar. 4, 1980

[54] CLEANING DEVICE

[76] Inventor: Elizabeth H. Rose, 1026 Gate Mills Towers, 6805 Mayfield Rd., Mayfield Hghts., Cleveland, Ohio 44124

[21] Appl. No.: 959,364

[22] Filed: Nov. 9, 1978

[51] Int. Cl.[2] ..... A47L 17/00

[52] U.S. Cl. ..... 15/225; 15/209 B; 15/228; 300/21

[58] Field of Search ..... 15/189, 207, 209 B, 15/225, 226, 230.13, 230.15, 234, 228; 428/4, 5; 301/21

[56] References Cited

U.S. PATENT DOCUMENTS

| | | | |
|---|---|---|---|
| 264,358 | 9/1882 | Smith | 15/226 |
| 581,109 | 4/1897 | Fairchild | 15/226 |
| 1,668,084 | 5/1928 | Oliver | 15/230.13 |
| 1,927,862 | 9/1933 | Zimmerman | 15/230.13 |
| 2,637,061 | 5/1953 | Ozdobinski | 15/226 |
| 3,205,519 | 9/1965 | Nowlin et al. | 15/209 B X |
| 3,336,618 | 8/1967 | Day | 15/209 B |
| 3,663,981 | 5/1972 | Du Crest | 15/225 |
| 3,877,105 | 4/1975 | Breland | 15/225 |
| 3,924,288 | 12/1975 | Breland | 15/225 |

*Primary Examiner*—Philip R. Coe

*Attorney, Agent, or Firm*—Cushman, Darby & Cushman

[57] ABSTRACT

Disclosed is a cleaning device which is grasped by a handle. A cord is attached to one edge of gathered coarse netting and the cord is fastened to a groove in the handle and wound around the handle so as to form multiple layers of the net material. The ends of the cord are stitched through the multiple layers of net material in order to prevent unwrapping, maintain the layers close to the handle and prevent rotating of the layers during hard use. The end of the handle near the groove is tapered in order to facilitate the cleaning of areas which are difficult to reach.

12 Claims, 4 Drawing Figures

Fig. 3
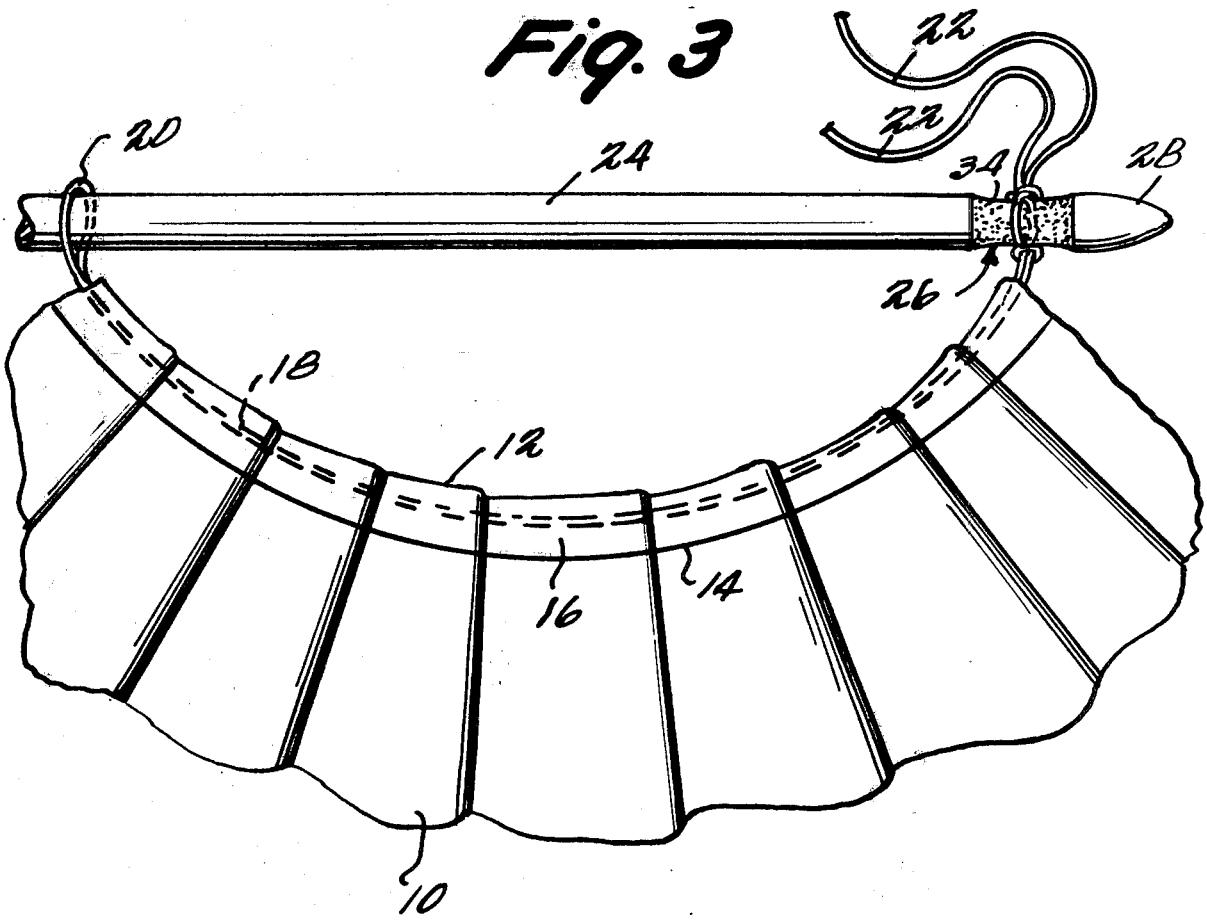
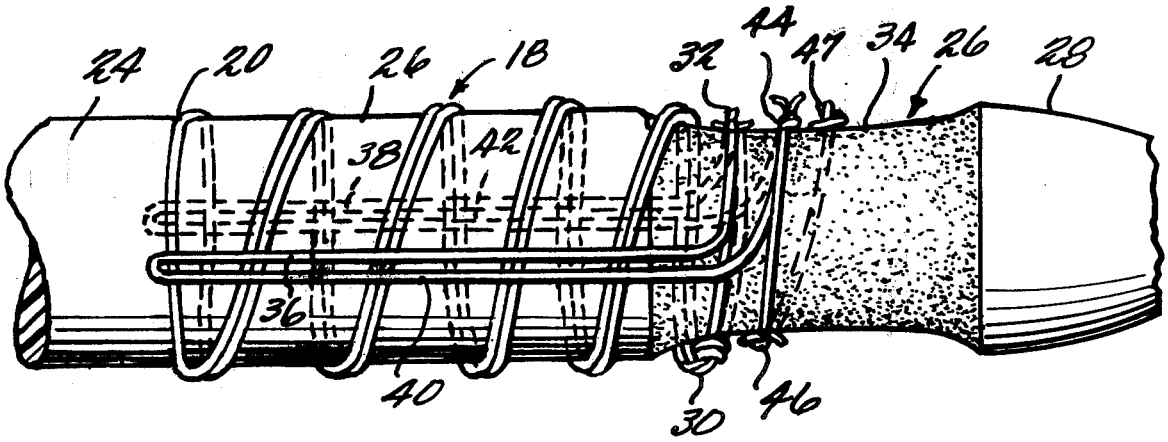
Fig. 4

CLEANING DEVICE

The present invention relates to a cleaning device which is grasped by a handle, and more particularly to such a device having a groove in the handle. Gathered coarse netting is wound about the groove and handle.

A number of mop-type devices are well-known in the art. U.S. Pat. No. 3,877,105 to Breland, discloses a brush having a head of gathered net material. A strip of coarse net material is gathered along its length by means of a cord. One end of the strip is glued to a groove in the handle and the strip is then tightly wound about the handle. The other end of the cord is then glued to the adjacent layers of cord and net material. The following U.S. patents disclose cleaning devices having gathered net material attached to handles:

| | |
|---|---|
| 3,924,288 | Breland |
| 3,663,981 | DuCrest, et al |
| 3,336,618 | Day |
| 3,205,519 | Nowlin, et al |

The basic problem inherent in all of these devices is the method of securing the net material to the handle. In many of these devices, the net material is likely to unwrap from or slip with respect to the handle. Also, cleaning difficult areas such as corners and faucets is laborious if not impossible with a number of these devices. In addition, since only the ends of the net material are bound in a number of these devices, the net material has a tendency to rotate during hard use, thereby reducing the effectiveness of the device.

The present invention overcomes these problems. In the present invention, an elongated handle has a peripheral groove adjacent to one end, which end is tapered. A material having a high coefficient of friction is applied to the groove. An elongated strip of synthetic loose-weave net material is folded along its elongated dimension in order to form a crease. A seam is stitched near the crease forming a channel. A double thickness of cord is threaded through the channel so that a loop extends from one end of the channel and the two ends of the cord extend from the other end of the channel. The handle is placed through the loop and the ends of the cord extending from the other end of the channel are tied about the groove. The loop is then rotated about the handle so that the cord and channel become tightly wound about the handle and groove.

The ends of the cord are then stitched through the layers of the net material formed by the wrapping step so that the material pierced by each stitch in each of the layers remains proximate to the material pierced by each stitch in the adjacent layers.

The tapered end, when covered by the net material, may be utilized to clean hard to reach areas such as corners and the like. The stitches through the multiple layers of net material have been found to effectively prevent unwrapping, maintain the layers close to the handle and prevent rotating of the layers during hard use. This device is particularly useful for cleaning bathtubs, shower stalls and the like which have areas difficult to reach and clean.

These and other objects and advantages of the invention will become more apparent and more readily appreciated from the following detailed description of the presently preferred exemplary embodiment of the invention taken in conjunction with the accompanying drawing, of which:

FIG. 3 is a diagrammatic illustration of the invention in an intermediate step of assembly; and FIG. 4 is an enlarged diagrammatic illustration of the path of the cord about the handle.

Figure 1:
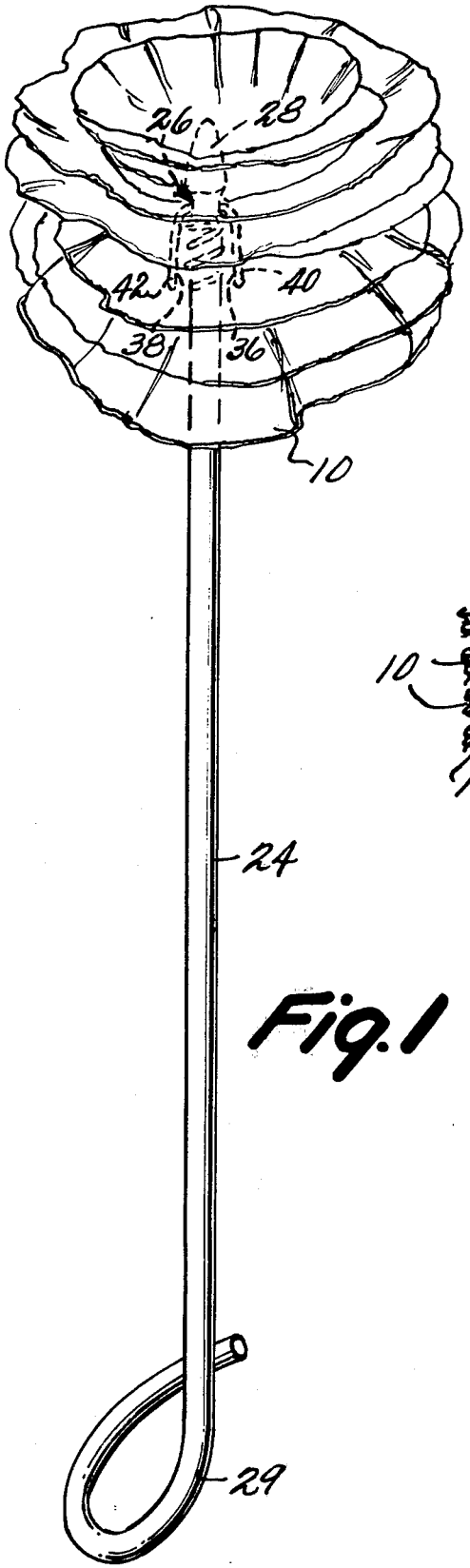
FIG. 1 is a prospective view of the invention.

Referring now to the Figures, an elongated strip of net material 10 is folded along its long dimension so as to form crease 12. Seam 14 is stitched in net 10 near crease 12 in order to form channel 16. In the preferred embodiment, net material 10 is an elongated strip of synthetic, loose-weave material, such as coarse nylon net. Typically, strip 10 initially has a length of six yards and a width of twelve inches. After material 10 is folded to form crease 12, the double thickness of the material has a width of six inches. Typically, seam 14 is stitched approximately ⅝ of an inch from crease 12.

A double thickness of cord 18 is threaded through channel 16. In the preferred embodiment, cord 18 is nylon seine twine, six feet in length before doubling. After cord 18 is threaded through channel 16, loop 20 extends beyond one end of channel 16 and ends 22 extends beyond the other end of channel 16.

Handle 24 has groove 26 near end 28 which is tapered. The other end of handle 24 is formed in a loop indicated by numeral 29. In the preferred embodiment, handle 24 is clear plastic. Loop 29 provides a convenient means for hanging and gripping the invention. Material 34 having a high coefficient of friction is applied to groove 26. In the preferred embodiment, material 34 comprises rubber bands which have been wound about groove 26.

Handle 24 is slipped through loop 20. Material 10 is then pushed tightly toward loop 20. In the preferred embodiment, material 10 is gathered on the ten inches of cord 18 nearest loop 20. At the point where ends 22 extend from channel 16, knot 30 is tied. In the preferred embodiment, knot 30 is an overhand loop knot. Material 34 prevents ends 22 between knots 30 and 32 from rotating about groove 26. A fixative, such as nail polish, is applied to knot 30 to prevent untying. Knot 30 is then positioned near the center of groove 26. Ends 22 extending from knot 30 are then wrapped on opposite sides of groove 26 and knot 32 is tied in ends 22 opposite knot 30 so that ends 22 are tightly affixed around opposite sides of groove 26.

Loop 20 is then rotated about handle 24 so that cord 18 and crease 12 of net material 10 is wound tightly around handle 24 and groove 26. It is preferred that each layer of net material 10 lie as close as possible to the adjacent layer as crease 12 is wound about groove 26. After crease 12 has been entirely coiled about handle 24, loop 20 is further twisted in order to tighten the wrapping and pack the layers together evenly.

Figure 2:
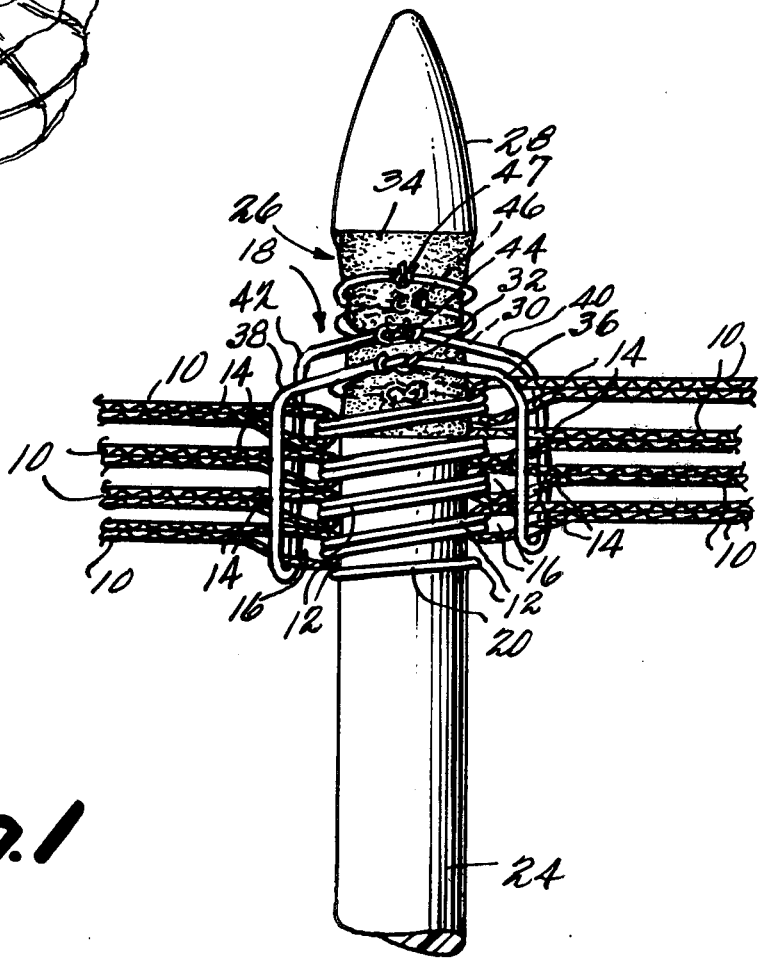
FIG. 2 is an enlarged fragmentary elevation of one end of the handle.

Each end 22 is then threaded on a relatively large needle. Each needle is then pushed through the layers of net material 10 on opposite sides of handle 24 so as to form stitches 36 and 38 as illustrated in FIGS. 2 and 4. After the needles have been pulled completely through the layers of net material 10 and stitches 36 and 38 have been pulled tight, the needle is reinserted in the net material and pushed back through the material in order to form stitches 40 and 42.

After stitches 40 and 42 are pulled tight, ends 22 are tied to form knot 44. The ends extending beyond knot 44 are wrapped around opposite sides of groove 26 and knot 46 is tied so that ends 22 between knots 44 and 46 are tightly wrapped around opposite sides of groove 26. The ends extending beyond knot 46 are wrapped around opposite sides of groove 26 and knot 47 is tied so that ends 22 between knots 46 and 47 are tightly wrapped around opposite sides of groove 26. Knots 44, 46 and 47 cooperate to insure that stitches 36, 38, 40 and 42 will not loosen during the life of the device. In the preferred embodiment, knots 32, 44, 46 and 47 are square knots. Each of these knots is coated with a fixative such as nail polish in order to prevent untying. Stitches 36 through 42 through the layers of net material 10 prevent unwrapping, maintain the layers close to the handle and prevent rotating of the layers during hard use.

In the preferred embodiment, handle 24 is approximately three feet long so that cleaning can be performed from a standing position. In order to clean the mop after use, material 10 is placed under running water so that debris is flushed therefrom. Handle 24 is then shaken to remove water from net material 10.

Although only one exemplary embodiment of this invention has been described in detail above, those skilled in the art will readily appreciate that many modifications are possible in the exemplary embodiment without materially departing from the novel teachings and advantages of this invention. Accordingly, all such modifications are intended to be included within the scope of this invention as defined in the following claims.

What is claimed is:

1. A mop-type device comprising:

an elongated strip of synthetic loose-weave net material of at least one thickness;

a handle having a peripheral groove near one end;

means for wrapping an elongated edge of said material in a spiral around said handle, said spiral wrapping of said edge around said handle forming multiple layers of said material;

means for maintaining at least one point of said material proximate said groove;

means for preventing said at least one point from rotating with respect to said groove; and means for prohibiting said material from unwrapping from said handle, said prohibiting means comprising at least one stitch in at least one direction through said multiple layers, said at least one stitch maintaining the material pierced by said at least one stitch in each of said layers proximate the material pierced by said at least one stitch in the adjacent of said layers.

2. Apparatus as in claim 1 wherein:

said one edge of said material is a crease in said net material;

said net material is at least double thickness; and said means for wrapping comprises cord disposed between said thicknesses and proximate to said crease, a loop in said cord extending beyond said crease in one direction, said handle being disposed within said loop, said cord being wrapped in a spiral around said handle.

3. Apparatus as in claim 2 wherein:

both ends of said cord extend beyond the same end of said crease, said loop extending beyond the opposite end of said crease; and said means for maintaining comprising a first knot tied between said ends near said same end of said crease, the ends of said cord beyond said first knot extending around said groove on opposite sides of said handle, and a second knot tied between said ends on the opposite side of said groove from said first knot.

4. Apparatus as in claim 1 wherein said one end of said handle is tapered.

5. Apparatus as in claim 1 wherein said means for preventing comprises a material having a high coefficient of friction disposed about said groove.

6. A mop-type device comprising:

an elongated strip of synthetic, loose-weave net material folded along its length so as to form a crease;

a handle having a peripheral groove near one end;

a cord positioned between the layers of said net material and proximate said crease, both ends of said cord extending beyond said material in a first direction, a loop in said cord extending beyond said material in an opposite direction, said handle extending through said loop, said cord being wrapped tightly in a spiral around said handle, the multiple turns of said cord around said handle forming multiple layers of said material;

a first knot in said ends of said cord near the edge of said material, said knot being proximate said groove;

said ends beyond said first knot extending on opposite sides of and proximate said groove;

a second knot between said ends on the side of said groove opposite said first knot for maintaining said ends on opposite sides of said groove tightly proximate said groove;

a material having a high coefficient of friction disposed between said groove and said first knot, said second knot, and said ends proximate said groove;

a first stitch with one of said ends extending from said second knot through said multiple layers;

a second stitch with said one end back through said multiple layers;

a third stitch with the other of said ends through said multiple layers on the side of said handle opposite said first and second stitches;

the fourth stitch with said other end back through said multiple layers;

a third knot between said ends and proximate said groove for tightly pulling said stitches;

said ends extending from said third knot disposed proximate and on opposite sides of said groove; and a fourth knot between said ends opposite said third knot, maintaining said ends on opposite sides of said groove tightly proximate said groove.

7. A method of making a mop-type device comprising the steps of:

wrapping an elongated edge of an elongated strip of synthetic, loose-weave net material of at least one thickness in a spiral about a handle having a peripheral groove near one end, said spiral wrapping of said edge around said handle forming mutliple layers of said material;

affixing at least one point of said material proximate one point in said groove; and stitching said multiple layers so as to maintain the material pierced by said stitching in each of said layers proximate the material pierced by said stitching in the adjacent of said layers for prohibiting said material from unwrapping from said handle.

8. A method as in claim 7 wherein said wrapping step comprises the steps of:

folding said net material along an elongated dimension so as to form a crease;

directing a cord between the layers of said material and proximate said crease so that said cord extends beyond opposite sides of said material;

forming a loop in said cord beyond one end of said material;

inserting said handle through said loop; and wrapping said cord in a spiral around said handle.

9. A method as in claim 7 wherein:

said directing step comprises the steps of doubling said cord so that both ends of the cord are together and extend beyond one end of the net material and a loop extends beyond the second end of the material; and said affixing step comprises the steps of tying a first knot in the ends of said cord, disposing a material with a high coefficient of friction in said groove, directing the ends of said cord extending from said first knot proximate to and around opposite sides of said groove, and tying a second knot in said ends opposite said first knot so as to maintain said ends about opposite sides of said groove tightly proximate to said groove.

10. A method of making a mop-device comprising the steps of:

folding a strip of synthetic, loose-weave net material along its elongated dimension so as to form a crease;

doubling a cord so that both ends of the cord are together, thus forming a loop opposite said ends;

directing said doubled cord between the layers of said material and adjacent to said crease so that said ends extend in one direction beyond said material and said loop extends in the other direction beyond said material;

inserting a handle having a peripheral groove near one end through said loop;

tying a first knot in said ends of said cord near the edge of said material;

affixing a material having a high coefficient of friction about said groove;

directing the ends of said cord extending from said first knot proximate to and around opposite sides of said groove;

tying a second knot between said ends opposite said first knot for maintaining said ends tightly proximate said groove;

wrapping said cord in a spiral around said handle, said spiral wrapping of said cord around said handle forming multiple layers of said material;

stitching each of said ends through said multiple layers in one direction and back, said stitching with one of said ends being on a side of said handle opposite the stitching with the other of said ends;

tying a third knot between said ends so as to tighten said stitches;

directing the ends of said cord extending from said third knot on opposite sides of said groove; and tying a fourth knot between said ends so as to maintain said ends about opposite sides of said groove tightly proximate to said groove.

11. A mop-type device comprising:

an elongated strip of synthetic loose-weave net material of at least one thickness;

a handle having a peripheral groove near one end;

means for spirally wrapping an elongated edge of said material around said handle, said spiral wrapping of said edge around said handle forming multiple layers of said material;

means for maintaining at least one point of said material proximate said groove;

means for preventing said at least one point from rotating with respect to said groove; and means for prohibiting said material from unwrapping from said handle, said prohibitinng means comprising at least one stitch in a direction substantially parallel to said handle and piercing through said mutliple layers, said at least one stitch maintaining the material pierced by said at least one stitch in each of said layers proximate the material pierced by said at least one stitch in the adjacent of said layers.

12. A method of making a mop-type device comprising the steps of:

wrapping an elongated edge of an elongated strip of synthetic, loose-weave net material of at least one thickness in a spiral about a handle having a peripheral groove near one end, said spiral wrapping of said edge around said handle forming multiple layers of said material;

affixing at least one point of said material proximate one point in said groove; and stitching through said multiple layers in a direction substantially parallel to said handle so as to maintain the material pierced by said stitching in each of said layers proximate the material pierced by said stitching in the adjacent of said layers for prohibiting said material from unwrapping from said handle.

* * * * *